US006502433B1

(12) United States Patent
Uhlin

(10) Patent No.: US 6,502,433 B1
(45) Date of Patent: Jan. 7, 2003

(54) DRUM-SHAPED CONTAINER FOR A LAUNDRY WASHING OR DRYING MACHINE

(75) Inventor: Göran Uhlin, Lagan (SE)

(73) Assignee: Aktiebolaget Electrolux, Stockholm (SE)

( * ) Notice: Subject to any disclaimer, the term of this patent is extended or adjusted under 35 U.S.C. 154(b) by 0 days.

(21) Appl. No.: 09/622,263

(22) PCT Filed: Dec. 16, 1999

(86) PCT No.: PCT/SE99/02389

§ 371 (c)(1),
(2), (4) Date: Aug. 14, 2000

(87) PCT Pub. No.: WO00/36205

PCT Pub. Date: Jun. 22, 2000

(30) Foreign Application Priority Data

Dec. 16, 1998 (SE) ..... 9804365

(51) Int. Cl.[7] ..... D06F 21/02
(52) U.S. Cl. ..... 68/24; 68/58; 68/140
(58) Field of Search ..... 68/24, 58, 140

(56) References Cited

U.S. PATENT DOCUMENTS 2,173,603 A * 9/1939 Dodge
2,214,131 A * 9/1940 Haberstump
2,426,078 A * 8/1947 Basset, Jr.
2,554,672 A * 5/1951 Johnston
2,575,335 A * 11/1951 Douglas
2,585,300 A * 2/1952 Condon
2,757,531 A * 8/1956 Fox
2,771,766 A * 11/1956 Dunlap
2,842,002 A * 7/1958 Stegman
2,867,107 A * 1/1959 Brown
2,911,810 A * 11/1959 Lantz et al.
2,963,892 A * 12/1960 Edwards
2,975,626 A * 3/1961 Frey
2,984,094 A * 5/1961 Belaieff
3,003,090 A * 10/1961 Neyhouse et al.
3,089,327 A * 5/1963 Stilwell, Jr.
3,101,625 A * 8/1963 Horvath
3,122,009 A * 2/1964 Jarvis
3,152,461 A * 10/1964 Glover, Jr.
3,841,117 A * 10/1974 Crivilles
5,433,091 A * 7/1995 Durazzani et al.
5,862,687 A * 1/1999 Jang
5,927,106 A * 7/1999 Pellerin
6,279,357 B1 * 8/2001 Didlick et al.

* cited by examiner

*Primary Examiner*—Frankie L. Stinson
(74) *Attorney, Agent, or Firm*—Pearne & Gordon LLP

(57) ABSTRACT

A drum-shaped container (10; 11) for a laundry washing or drying machine comprises a cylindrical sheet metal envelope (12; 14) and gables (13; 15) also made from sheet metal and fastened to said cylindrical envelope, at least one of said gables being provided with a centrally disposed rotative shaft (16) for the container (10; 11) or with a support (17) for such rotative shaft (16). The sheet metal gable (13; 15) provided with the rotative shaft (16) or the shaft support (17) has a conical shape in the direction towards the in and the cone angle (2$\alpha$) is chosen so that the stress acting on the sheet metal gable (13; 15) is mainly a compressive stress ($\sigma_H$). Suitably, the cone angle is equal to or less than 150°, preferably in the range of 140° to 150°.

2 Claims, 1 Drawing Sheet

DRUM-SHAPED CONTAINER FOR A LAUNDRY WASHING OR DRYING MACHINE

Figure 1:
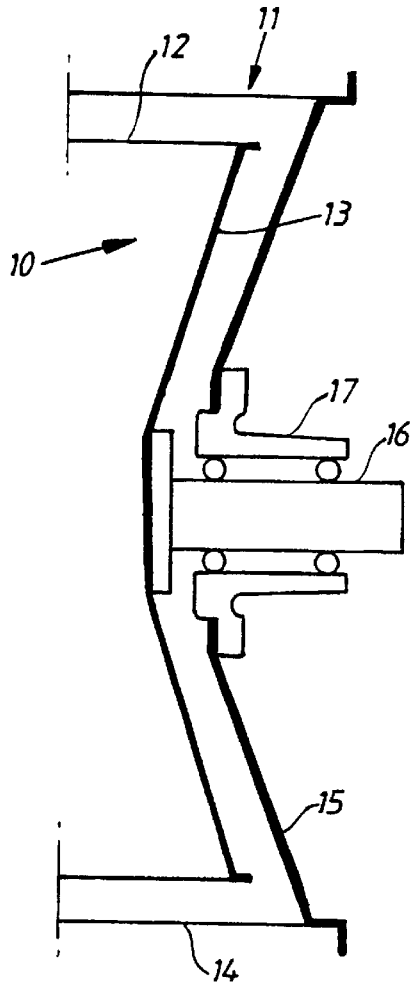

The present invention relates to a drum-shaped container for a laundry washing and/or drying machine, comprising a cylindrical sheet metal envelope and gables also made of sheet metal and fastened thereto, at least one of said gables being provided with a centrally disposed rotative shaft for the container or with a support for such rotative shaft.

A washing or drying machine for treatment of textiles often is designed to support the textiles in an inner drum which is enclosed in and rotatably supported by an outer drum. The washing machine can be designed to be loaded via a door provided in the periphery of the inner drum and via a corresponding opening provided in the outer drum which during operation of the machine is covered by an outer machine lid. In another common type of washing machine loading takes place via corresponding openings in one gable of the inner and outer drum, respectively. Closing of the openings can take place in different ways. For example, a door can be provided to close the opening in the inner drum. In another embodiment the opening in the inner drum is connected to the opening in the outer drum via a bellows gasket and the opening in the outer drum is in turn closable by means of an outer machine lid.

In an embodiment. where loading takes place via openings in the drum periphery, referred to as a top loaded machine, the inner drum is journalled at both gables whereas in an embodiment wherein loading takes place via gable openings, referred to as a front loaded machine, the rotatable shaft is journalled at one end only. A problem, in particular observed in a front loaded machine, occurs in connection with the construction of the shaft and the shaft support for the inner drum. In order to absorbe the great forces arising when the inner drum and its load is driven up into centrifugal speed the gable with the drum shaft of the inner drum must be given a design of particular strength. This is also true for the outer drum with its shaft support.

An example of a common design of the inner drum and outer drum with its drum support for a laundry washing machine is given in the patent document U.S. Pat. No. 2,984,094. The document shows in FIG. 2 one gable of the outer drum comprising two conical sheet metal gables joined at there periphery and facing each other so as to diverge towards their central parts where they form a shaft support. Another example is given in the patent document U.S. Pat. No. 3,841,117 which in FIG. 1 clearly shows the strong construction of the gable of the inner drum provided with the shaft and the equally strong shaft support connected to the corresponding gable of the outer drum.

The prior art discloses solutions wherein with straight single gables a considerably greater thickness of sheet metal has to be used than required for the remaining tasks of the inner and the outer drum, namely the supporting of the laundry and of the wash liquor, respectively. The prior art also discloses solutions wherein by using double sheet metal gables of different conical shapes it has been possible to reduce the sheet metal thickness and hence weight and cost.

The object of the invention is to suggest a solution with a single sheet metal gable construction for both inner and outer drum without the thickness of the sheet metal reaching disproportionately heavy levels. The object is achieved in a drum-shaped container for a laundry washing and/or drying machine having the characterizing features indicated in the appending claims.

Figure 2:
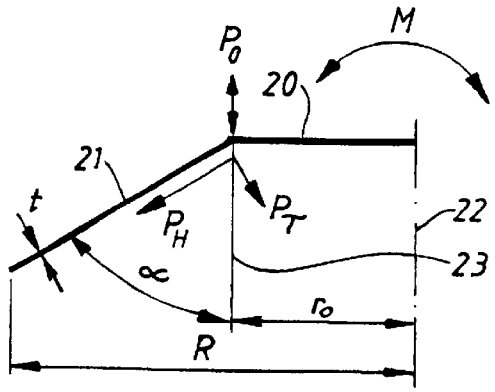

The invention will now be described more in detail in connection with the enclosed drawings, in which:

FIG. 1 schematically shows a longitudinal section through an arrangement comprising an inner drum, an outer drum, a shaft and a shaft support, in which needless parts have been omitted for the sake of clarity, and FIG. 2 schematically shows a section through a conical sheet metal gable in the area surrounding the centrally disposed shaft joint.

The prior art has already suggested the use of conically formed sheet metal gables for the inner and outer drum, respectively, for the purpose of reducing the required thickness of the sheet metal. However, with respect to the inner drum, in order to achieve the required thrength at least two sheet metal gables have been provided which have been joined at the gable periphery and secured to a shaft at the central parts thereof. In order to achieve a strong shaft joint the sheet metal gables have different cone angles. A smilar reasoning has been used for the corresponding gable of the outer drum where sufficient axial space must be provided for the shaft support.

Now, the designer has played with the idea of getting rid of these double sheet metal gable assemblies in favour of single gables of conical shape. One such imaginary embodiment is shown schematically in FIG. 1. As shown in the figure, in the usual way an inner drum 10 is rotatably mounted in an outer drum 11. The inner drum comprises a tube-shaped sheet metal envelope 12 at one connected to a conical sheet metal gable 13. Correspondingly, the outer drum 11 comprises a tube-shaped sheet metal envelope 14 one end of which is connected to a sheet metal gable 15 of conical shape. The sheet metal gable 13 has a centrally disposed shaft 16 journalled in a shaft support 17, for example comprising ball bearings, provided centrally in the outer drum 11. Only one side of the inner and outer drum, respectively, has been shown in FIG. 1 as, in the first place, this side of the respective drum has to absorbe the forces generated during rotation of the inner drum.

For the determination of the parameters required in connection with the design of the drum gables formulas are used which have been taken from the handbook "Formulas for Stress & Strain" of Roark, McGraw Hill, and from "Skalhandboken", Mekanförbundets förlag. These formulas have been adapted with regard to the use of conical sheet metal for the inner and outer drum, respectively, of a laundry washing and/or drying machine. The formulas, given below, will be explained more in detail with reference to FIG. 2.

$$P_0=M/(n\cdot r^2)$$

$$P_H=M/(n\cdot r^2\cdot\cos\alpha)$$

$$P_\tau=M\cdot\sin\alpha/(n\cdot r^2)$$

$$\sigma_H=M/(n\cdot r^2\cdot t\cdot\cos\alpha)$$

$$\tau=M\cdot\sin\alpha/(n\cdot r^2\cdot t)$$

In FIG. 2 those control parameters are indicated which are of importance in designing gables of the inner and outer drum of a laundry washing and/or drying machine intended for absorption of the forces arising during operation of the machine. The figure schematically shows one half of a sheet metal gable comprising a central portion 20, being perpendicular to an imaginary axis of rotation, and a surrounding conical portion 21. In the figure the axis of rotation is represented by a line of symmetry 22 and a line 23 parallel to the line of symmetry and indicating the radius $r_0$. of the joint part. In an inner drum the joint part is a shaft and in an outer drum the joint part is a shaft support. The designation R indicates the radius of the sheet metal gable outwards to the joining point of a cylindrical sheet metal envelope which together with two sheet metal gables forms the drum, irrespective of the kind of drum, an inner drum or an outer drum. The thickness of the gable sheet metal is designated by "t" and the conicity thereof is indicated by half of the cone angle and designated by $\alpha$. The formulas for force per unit of length have the unit N/m and the formulas for stress have the unit $N/M^2$.

Among the formulas given above the first one is a formula indicating the axial force $P_0$ in the transitional area between the axial and conical portions of the sheet metal gable as a function of the torque M and a running radius r in the area between the joint part radius $r_0$ and the radius R. The second formula provides an expression for the component $P_H$ of the force $P_0$ in a direction coinciding with the generatrix of the conical portion 21. Correspondingly, the third formula provides an expression for the component $P_\tau$, which is perpendicular to the component $P_H$. The fourth formula provides an expression for the stress $\sigma_H$ acting on the conical sheet metal gable and the fifth formula, finally, provides an expression for the shearing stress $\tau$ acting on the sheet metal.

As mentioned above the prior art has used conically shaped sheet metal gables for drums in laundry washing and drying machines. Regularly, double sheet metal gables of mutually different conicity have been used in order to achieve appropriate constructive strength. It has not been considered an alternative to provide a single metal sheet gable because of the estimated too great thickness of the sheet metal and the undesired resulting increase of the weight of the rotating inner drum and of the outer drum provided with the shaft support.

Now, tests have proven that despite the doubtful conditions it is still possible to use a single conical sheet metal gable if the cone angle is chosen properly. This is true irrespective of whether an inner drum or an outer drum in a laundry washing or drying machine is concerned. Determining in this context is that with reference to the above formulas the cone angle is chosen so that the remaining stress on the coned sheet metal gable 21 mainly consists of the compressive stress σH. According to the invention the cone angle is to be chosen so as to be equal to or less than 150°, preferably in the range of 140° to 150°. From pure strength point of view an even smaller cone angle could be chosen but at an cone angle below 140° the laundry has shown a tendency to form twisted units and for that reason the selection of a cone angle below 140° has been avoided. With reference to FIG. 1, in an operative machine of the kind indicated the diameter of an inner drum 12 can amount to 500 mm and the diameter of the shaft joint ($2\times r_0$) to 100 mm while the thickness of the sheet metal amounts to 2 mm. With a cone angle within the given range a drum gable designed in. this way can stand rotation at about 1200 rpm corresponding to a stress of 350 g.

By the invention the need for drum gable constructions in which several sheet metal gables cooperate for the achievement of sufficient strength has been remedied and it will be possible to provide simpler designs with reduced weight and less consumption of material. The required thickness of the sheet metal can be reduced to levels still required for the remaining functions of the drums, namely for the inner drum to support the laundry and for the outer drum to support the required wash and rinse liquids.

The invention is not limited to the embodiments described above and given as example but can be modified within the scope given by the appending claims.

What is claimed is:

1. A drum-shaped container (10; 11) for a laundry washing or drying machine comprising a cylindrical sheet metal envelope (12; 24) and gables (13; 15) also made from sheet metal and fastened to said sheet metal envelope, at least one of said gables being provided with a centrally disposed rotative shaft (16) for the container or with a shaft support (17) for such rotative shaft (16), wherein the sheet metal gable (13; 15) provided with a rotative shaft (16) or a shaft support (17) has a conical shape in the direction toward the interior of the container, wherein the cone angle (2$\alpha$) is chosen so that the stress acting on the sheet metal gable (13; 15) mainly consists of a compressive stress ($\delta_H$) and wherein the cone angle (2$\alpha$) is equal to or less than 150°.

2. The container according to claim 1, wherein the cone angle (2$\alpha$) is between about 140° to 150°.

* * * * *

UNITED STATES PATENT AND TRADEMARK OFFICE

CERTIFICATE OF CORRECTION

PATENT NO. : 6,502,433 B1
DATED : January 7, 2003
INVENTOR(S) : Göran Uhlin

It is certified that error appears in the above-identified patent and that said Letters Patent is hereby corrected as shown below:

Title page,
Item [57], ABSTRACT,
Line 9, please delete "in", and insert therefor -- interior of the container --.

Column 1,
Line 26, please delete "embodiment.", and insert therefor -- embodiment --.

Column 2,
Line 64, please delete "$r_o$.", and insert therefor -- $r_o$ --.

Column 3,
Line 8, please delete "$N/M^2$", and insert therefor -- $N/m^2$ --.

Signed and Sealed this

Twenty-fourth Day of June, 2003

JAMES E. ROGAN
*Director of the United States Patent and Trademark Office*